US008324520B2

(12) United States Patent
Song

(10) Patent No.: US 8,324,520 B2
(45) Date of Patent: Dec. 4, 2012

(54) DISCONNECTOR WITH FRONT AND SIDE OPERATIONAL ACCESS

(75) Inventor: Lei Song, Jiangsu (CN)

(73) Assignee: Siemens Aktiengesellschaft, Munich (DE)

( * ) Notice: Subject to any disclaimer, the term of this patent is extended or adjusted under 35 U.S.C. 154(b) by 302 days.

(21) Appl. No.: 12/793,742

(22) Filed: Jun. 4, 2010

(65) Prior Publication Data

US 2010/0326810 A1 Dec. 30, 2010

(30) Foreign Application Priority Data

Jun. 29, 2009 (CN) ..... 2009 1 0151502

(51) Int. Cl.
*H01H 3/42* (2006.01)

(52) U.S. Cl. ..... 200/574

(58) Field of Classification Search ..... 200/573–574, 200/43.07
See application file for complete search history.

(56) References Cited

U.S. PATENT DOCUMENTS 5,420,385 A * 5/1995 Cooper ..... 200/43.07
6,365,850 B1 * 4/2002 Arnold et al. ..... 200/17 R
7,605,335 B2 * 10/2009 Hiltl et al. ..... 200/43.04
8,173,914 B2 * 5/2012 Poyner ..... 200/43.04
* cited by examiner

*Primary Examiner* — Vanessa Girardi
(74) *Attorney, Agent, or Firm* — Harness, Dickey & Pierce, P.L.C.

(57) ABSTRACT

A disconnector is disclosed, including a first operating element. The operating element is provided with a pivoting element, including a cam wheel which is in the form of a disk and has two opposite cams, with the rotation axis of this cam wheel which is in the form of a disk being at right angles to the axis of the first operating element, and with the cam wheel which is in the form of a disk having two protuberances, which can in each case make contact with the pivoting element in different operating states. In at least one embodiment, the disconnector includes a holding opening, which is arranged on at least one end surface, which is in the form of a disk, of the cam wheel which is in the form of a disk, and including a second operating element, which is fitted in the holding opening, with this second operating element having a body, an operating opening which is located in the center part of the body, and two vane pieces which are fitted on both sides of the body. In at least one embodiment, the second operating element can rotate relative to the holding opening, and can produce a rotatary movement of the cam wheel which is in the form of a disk. The disconnector according to at least one embodiment of the invention can be operated both from the front and from the side, with side operation being independent manual operation.

11 Claims, 4 Drawing Sheets

DISCONNECTOR WITH FRONT AND SIDE OPERATIONAL ACCESS

PRIORITY STATEMENT

The present application hereby claims priority under 35 U.S.C. §119 on Chinese patent application number CN 200910151502.3 filed Jun. 29, 2009, the entire contents of which are hereby incorporated herein by reference.

FIELD

At least one embodiment of the invention generally relates to a disconnector with additional manual operation at the side.

BACKGROUND

A disconnector is an apparatus which is frequently used in circuits. It can change its switching state by operation from the front or from the side. In general, in the case of a disconnector, the operation from the front or the operation from the side cannot be changed. In order to make it possible to change from operation from the front or operation from the side, in some products, the operation from the side is not an independent manual operation. This means that the speed of the mechanical movement is correlated with the speed of the manual operation, or an additional apparatus is required to provide this function, such as the addition of a side operating shaft or a drive cam wheel for the change.

CN2847501Y discloses a disconnector whose operating apparatus operates under the influence of the stored energy of a spring. A dead-center point is passed with the aid of a linkage mechanism. The movements for disconnection and closing are carried out assisted by the spring force. The movements of the switch are independent of manual force, thus ensuring the reliability and stability of its movements. However, this switch is not able to provide operation from the front and operation from the side, between which it is possible to change.

SUMMARY

In at least one embodiment of the invention provides a disconnector which can be operated not only from the front but also allows direct independent manual operation from the side without any need for an additional apparatus.

In at least one embodiment, the invention proposes a disconnector having a cam wheel (preferably in the form of a disk) via which the disconnector can be switched on and off, wherein the cam wheel is mounted such that it can rotate between two limit positions, and wherein one limit position corresponds to the switched-on state and the other corresponds to the switched-off state of the disconnector, having two cams (projections) which are formed on the cam wheel, are located opposite one another and extend transversely with respect to the rotation axis of the cam wheel, wherein the cams have a (preferably symmetrical) external contour with an apex point, having two pressure elements which each rest on the external contour (preferably in the sliding form), applying force, and press against the cams, wherein they each produce a torque during rotation of the cam wheel after passing over the apex point, which torque automatically rotates the cam wheel further to the respective limit position, having a rotatable first operating element (drive shaft), whose rotation axis runs transversely with respect to the rotation axis of the cam wheel and on which a pivoting element (contact part) is arranged fixed, wherein the pivoting element extends outward transversely with respect to the rotation axis of the first operating element, having two (preferably radial) protuberances, arranged between the cams with an angular separation on the cam wheel, wherein the pivoting element in each case extends into the space between the two protuberances, presses against one of the protuberances during pivoting, and in the process rotates the cam wheel beyond the apex point in the direction of a limit position, and wherein after passing over the apex point, the cam wheel is in each case rotated further by the pressure elements having a holding opening (notch) which is formed in the cam wheel and runs in the direction of the rotation axis of the cam wheel, having a second operating element (sliding piece, switching shaft, switching shaft segment, switching shaft connecting piece), which is mounted in the holding opening such that it can rotate with an angular play and having two stops, which limit the angular play and about which the cam wheel can be rotated by the second operating element beyond the apex point in the direction of a limit position, with the angular play being chosen to be sufficiently great that, after passing over the apex point, the cam wheel is in each case rotated further by the pressure elements without the stops impeding the associated limit position being reached.

In other words, at least one embodiment of the invention achieves a disconnector including a first operating element, with this first operating element being provided with a pivoting element. In addition, in at least one embodiment the disconnector comprises the following items: a cam wheel in the form of a disk with two opposite cams, with the rotation axis of this cam wheel which is in the form of a disk, being at right angles to the axis of the first operating element, and with the cam wheel which is in the form of a disk comprising the following: a first protuberance and a second protuberance, which can each make contact with the pivoting element in different operating states, and a holding opening which is arranged on at least one end surface, which is in the form of a disk, of the cam wheel which is in the form of a disk; a second operating element which is fitted in the holding opening, with this second operating element comprising the following: a body, an operating opening located in the center part of the body, and two vane pieces fitted on both sides of the body.

The second operating element can rotate relative to the holding opening, and can produce a movement of the cam wheel which is in the form of a disk.

The holding opening is preferably provided with vane openings which correspond to the vane pieces, in which case the vane pieces can rotate relative to the vane openings.

Each vane piece is preferably provided internally with a vane opening.

The holding opening is preferably provided internally with two positioning bolts, each positioning bolt is located in a vane opening, and rotation relative to the positioning bolts is possible in the vane openings.

In order to simplify the machining and assembly, the two vane pieces are preferably fitted radially symmetrically on both sides of the body.

The disconnector according to at least one embodiment of the invention can be operated manually from the front or from the side by the operator. The choice can be made at any given time depending on the requirements. There is no mutual interference between the types of operation. Since relative rotation is possible between the vane pieces and the holding opening, the actions of the operator are not related to the speed and force of the disconnector. Independent manual operation from the side is achieved by a single attachment, without an additional apparatus being added.

BRIEF DESCRIPTION OF THE DRAWINGS

The following figures serve only for schematic description and explanation of embodiments of the invention, and in no way restrict the scope of this invention. In the figures.

DETAILED DESCRIPTION OF THE EXAMPLE EMBODIMENTS

Figure 1:
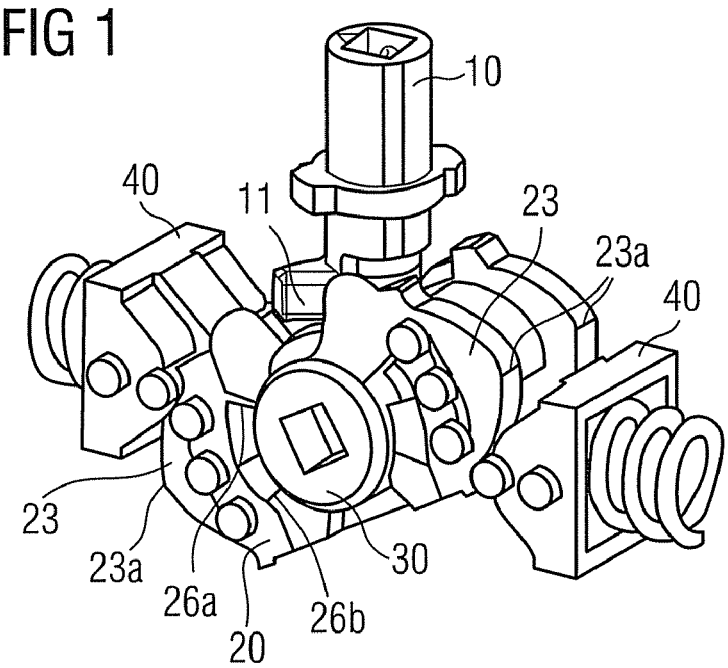
FIG. 1 shows a schematic illustration of the design of the disconnector.

Various example embodiments will now be described more fully with reference to the accompanying drawings in which only some example embodiments are shown. Specific structural and functional details disclosed herein are merely representative for purposes of describing example embodiments. The present invention, however, may be embodied in many alternate forms and should not be construed as limited to only the example embodiments set forth herein.

Accordingly, while example embodiments of the invention are capable of various modifications and alternative forms, embodiments thereof are shown by way of example in the drawings and will herein be described in detail. It should be understood, however, that there is no intent to limit example embodiments of the present invention to the particular forms disclosed. On the contrary, example embodiments are to cover all modifications, equivalents, and alternatives falling within the scope of the invention. Like numbers refer to like elements throughout the description of the figures.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments of the present invention. As used herein, the term "and/or," includes any and all combinations of one or more of the associated listed items.

It will be understood that when an element is referred to as being "connected," or "coupled," to another element, it can be directly connected or coupled to the other element or intervening elements may be present. In contrast, when an element is referred to as being "directly connected," or "directly coupled," to another element, there are no intervening elements present. Other words used to describe the relationship between elements should be interpreted in a like fashion (e.g., "between," versus "directly between," "adjacent," versus "directly adjacent," etc.).

The terminology used herein is for the purpose of describing particular embodiments only and is not intended to be limiting of example embodiments of the invention. As used herein, the singular forms "a," "an," and "the," are intended to include the plural forms as well, unless the context clearly indicates otherwise. As used herein, the terms "and/or" and "at least one of" include any and all combinations of one or more of the associated listed items. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

The specific embodiments of the invention will be described with reference to the figures, for clearer understanding of the technical features, aims and effects of embodiments of the invention, with identical inscriptions in the individual figures denoting identical parts. For clear illustration of the design and of the mutual relationships between the individual parts, the proportional relationships between the individual parts are only schematic in the figures. The figures are in no way an illustration of the proportional relationships in the actual design. Furthermore, the attributes "top", "bottom", "left", "right", "first" and "second" mentioned in the description before the relevant annotations are used only to express the relative position relationships between the individual parts, but not to express the absolute position and the assembly steps of the parts, as well as the relative importance.

EXAMPLE EMBODIMENT 1

FIG. 1 shows a schematic illustration of the design of a disconnector according to an embodiment of the invention. As illustrated in the figure, this disconnector has a (first) operating element 10, with the operating element 10 being provided with a pivoting element 11. This disconnector also has a cam wheel 20 in the form of a disk with opposite cams 23, with the rotation axis of this cam wheel 20, which is in the form of a disk, running at right angles to the axis of the operating element 10. The cams 23 are supported on pressure elements 40 (spring parts), in which case the pressure elements 40 can move backward and forward along the contour line of the cams 23, on the basis of the rotation of the cam wheel 20, which is in the form of a disk. At the same time, a first protuberance 21 and a second protuberance 22 are provided on the cam wheel 20, which is in the form of a disk. The two protuberances 21 and 22 can each make contact with the pivoting element 11 (contact part) when the disconnector is in the open/closed state.

Figure 2:
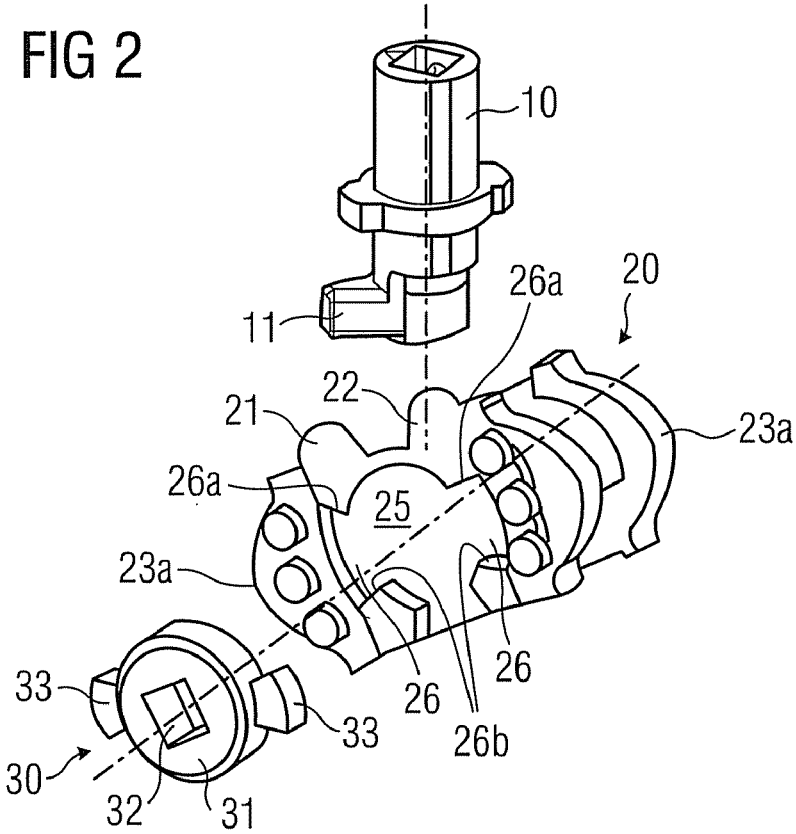
FIG. 2 shows a three-dimensional exploded illustration of the disconnector shown in FIG. 1, FIGS. 3 to 5 show schematic diagrams of the operating processes for operation of the disconnector from the side, as shown in FIG. 1, FIGS. 6 to 8 show schematic diagrams of the operating processes for operation of the disconnector from the front, as shown in FIG. 1

FIG. 2 shows a three-dimensional exploded illustration of the disconnector shown in FIG. 1. As illustrated in the figure, a holding opening 25 is arranged on an end surface, which is in the form of a disk, of the cam wheel 20, which is in the form of a disk. A (second) operating element 30 (sliding piece) is provided in the holding opening 25. The operating element 30 has a body 31 with an operating opening 32 being located in the center part of the body 31. Two vane pieces 33 are provided on both sides of the body 31. The operating element 30 can rotate relative to the holding opening 25 in the holding opening 25, and can cause the cam wheel 20, which is in the form of a disk, to rotate.

It is, of course, also possible to incorporate a holding opening 25 on both end surfaces, which are in the form of disks, of the cam wheel 20 which is in the form of a disk. This makes it possible to operate both end surfaces of the cam wheel which is in the form of a disk, thus enhancing the usefulness of the disconnector. For example, a triangular shape, a hexagonal shape etc. can also be used for the operating opening 32.

In one specific embodiment of the invention, the holding opening 25 has vane openings 26 (vane notches) which correspond to the vane pieces 33. When the total space is larger than the space which the vane pieces 33 actually occupy, the vane pieces 33 can rotate in the vane openings 26, relative to the vane openings 26.

In order to simplify the machining and assembly, the two vane pieces 33 and the vane openings 26 may be incorporated radially symmetrically on both sides of the body 31 of the operating element 30 and of the holding opening 25.

The following text provides a detailed description of how the disconnector illustrated in FIGS. 1 and 2 provides independent operation from the side, and how the change between operation from the front and operation from the side is implemented.

Figure 3:
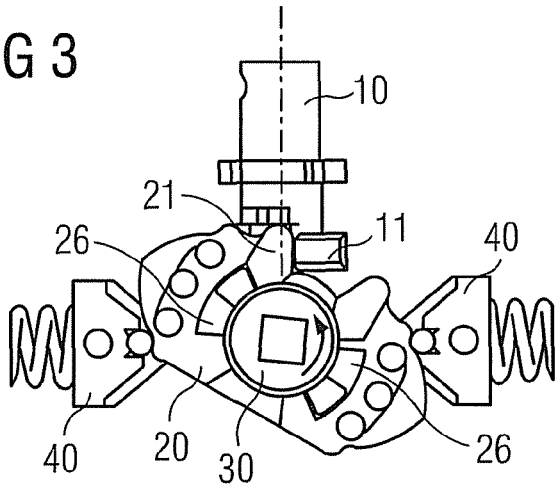
Figure 4:
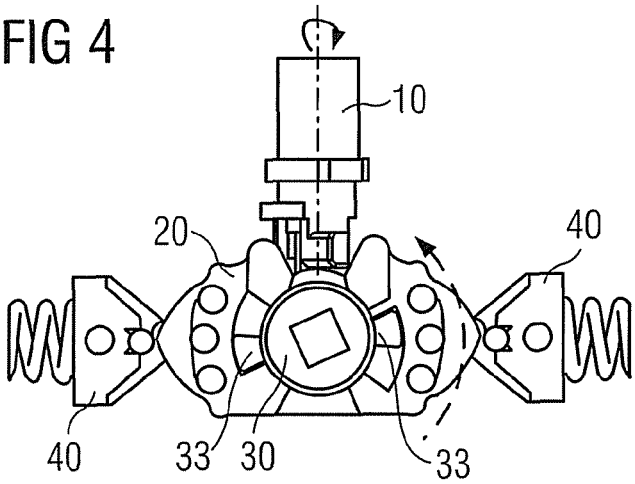
Figure 5:
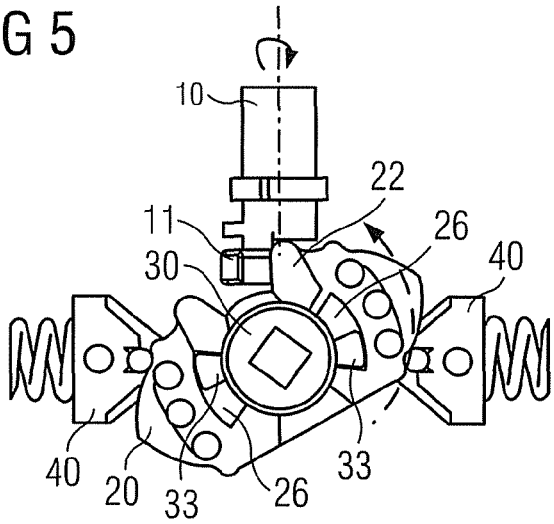

FIGS. 3 to 5 show operation of the disconnector from the side, as shown in FIG. 1. In order to simplify the description, it is assumed that the position of the switch illustrated in FIG. 3 is the initial open/close position. The disconnector is operated manually by rotating the operating element 30. As illustrated in FIG. 3, the pressure elements 40 press on both sides in the clockwise direction on the cam wheel 20, which is in the form of a disk, and result in the first protuberance 21 being supported against the pivoting element 11, as a result of which the operating element 10 is fixed in the open/close position.

When the operating element 30 is rotated in the counterclockwise direction, in the direction indicated by the arrow in FIG. 3, the vane pieces 33 are in consequence likewise rotated. Because of the angular play, the vane pieces 33 first of all rotate in the vane openings 26 and then, after making contact with a stop 26*a* or 26*b*, cause the cam wheel 20, which is in the form of a disk, to rotate along the opposite clockwise direction, as indicated by the dashed line in FIG. 4, to the position which is illustrated in FIG. 4. The cam wheel 20, which is in the form of a disk, is then located in the center position. The direction of the effect of the pressure elements 40 on the cam wheel 20 which is in the form of a disk is located at a balanced critical point, the apex point. The cam wheel 20 which is in the form of a disk cannot complete any rotation in the clockwise direction or counterclockwise direction. The angular play 26*a*-26*b* is the angle range between the stops 26*a* and 26*b*.

As shown in FIG. 5, the operating element 30 is rotated further, and the cam wheel 20 which is in the form of a disk is rotated further in the counterclockwise direction. The central position shown in FIG. 4 is passed, and the pressure elements 40 start to press on the cam wheel 20, which is in the form of a disk, in the opposite clockwise direction, thus rotating the cam wheel 20, which is the form of a disk, in the counterclockwise direction. The operating element 30 can then not rotate with the cam wheel 20 which is in the form of a disk. There is no collision between the two. The cam wheel 20 which is in the form of a disk can quickly rotate to the position shown in FIG. 5. The second protuberance 22 acts on the pivoting element 11 during this process, and simultaneously results in the operating element 10 being rotated in the direction indicated by the arrow with the solid line in FIG. 5, thus changing the open/close position of the disconnector.

When the operating element 30 is rotated in the clockwise direction, the movements of all the parts of the disconnector are similar to the movements steps illustrated in FIGS. 3 to 5 but in the opposite directions. The disconnector is finally caused to move back to the initial open/close position. This will not be described in detail again here.

Figure 6:
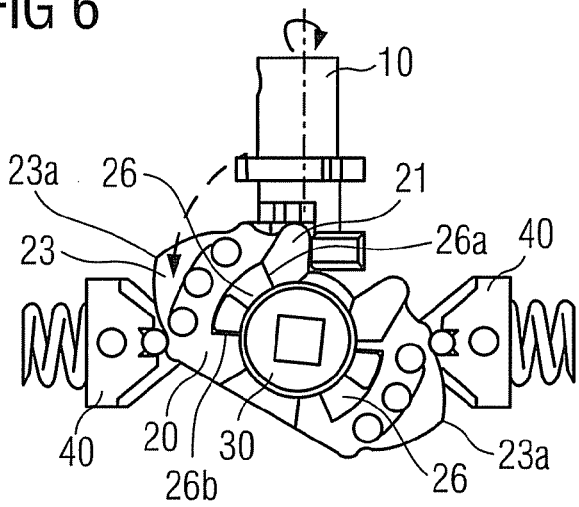
Figure 7:
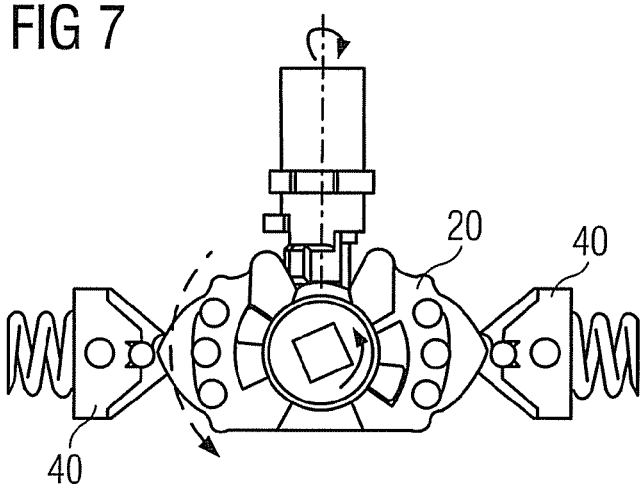
Figure 8:
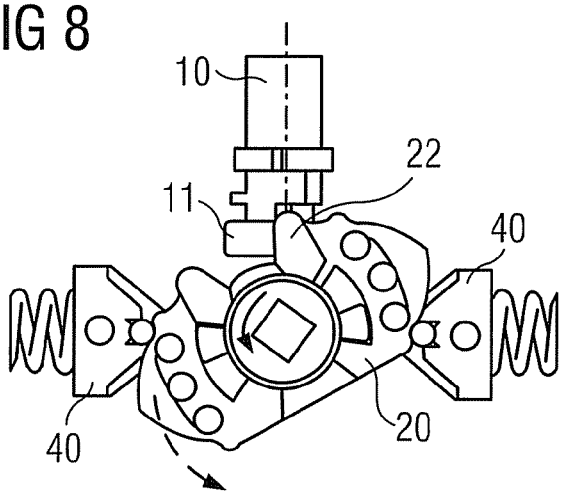

FIGS. 6 to 8 show phases of operation of the disconnector from the front, as shown in FIG. 1. FIG. 6 shows the initial open/close position of the disconnector, with the positions of the operating element 10, of the cam wheel 20 which is in the form of a disk, and of the pressure elements 40 being identical to the positions illustrated in FIG. 3.

The operating element 10 is rotated in the clockwise direction, in the direction of the arrow with the solid line in FIG. 6. The first protuberance 21 is subject to the influence of the operating element 10, and causes the cam wheel 20, which is in the form of a disk, to rotate in the counterclockwise direction (in the direction of the arrow with a dashed line in the figure). Because of the existence of the intermediate space 26 between the operating element 30 and the holding opening, the operating element 30 is not rotated in this case. The pressure elements 40 are subject to the pressure of the cams 23 on the cam wheel 20 which is in the form of a disk, as a result of which the pressure elements 40 are compressed, for energy storage.

The operating element 10 is rotated further. When the cam wheel 20 which is in the form of a disk has been rotated in the counterclockwise direction to the central position shown in FIG. 7, the effect of the pressure elements 40 on the cam wheel 20 which is in the form of a disk is located at a balanced critical point, the apex point. The cam wheel 20 which is in the form of a disk cannot complete any rotation in either the clockwise direction or the counterclockwise direction.

As illustrated in FIG. 8, the first operating element 10 is rotated further, as a result of which the cam wheel 20, which is in the form of a disk, passes over the central position shown in FIG. 7. In the process, the direction in which the pressure of the pressure elements 40 acts on the cam wheel 20 which is in the form of a disk changes, as a result of which the cam wheel 20 which is in the form of a disk rotates in the counterclockwise direction. The cam wheel 20 which is in the form of a disk then rotates quickly to the position shown in FIG. 8. The second protuberance 22 acts on the pivoting element 11 of the operating element 10, thus changing the open/close position of the disconnector. If the operating element 10 is once again rotated in the counterclockwise direction, the movements of all the parts of the disconnector are similar to the movement steps illustrated in FIGS. 6 to 8, but in the opposite directions. Finally, the disconnector is caused to return to the initial open/close position. This will not be described in detail again here.

Since an adequate intermediate space remains between the first protuberance 21 and the second protuberance 22, the cam wheel 20 which is in the form of a disk does not block the rotation of the operating element 10. The cam wheel 20 which is in the form of a disk and the operating element 30 can operate independently of one another, thus producing a mutual change from operation from the front and operation from the side. This means that, although the operator operates the mechanism from the front, it can just as well be operated from the side, however.

Not only can the disconnector be operated from the front as in the case of conventional products, but it is also possible to change easily to operation from the side. Since the cavities in the vane openings 26 are larger than the vane pieces 33, the vane pieces 33 can rotate freely with angular play in the vane openings 26. The speed of manual operation influences only the speed of the transition from FIG. 3 to the state in FIG. 4. It has no influence on the speed of the transition from FIG. 4 to the state in FIG. 5. The switching rate of the open/close states of the disconnector is governed mainly by the rate of change of the transition from FIG. 4 to the state in FIG. 5. Independent manual operation from the side has therefore been achieved without adding an additional apparatus.

EXAMPLE EMBODIMENT 2

Figure 9:
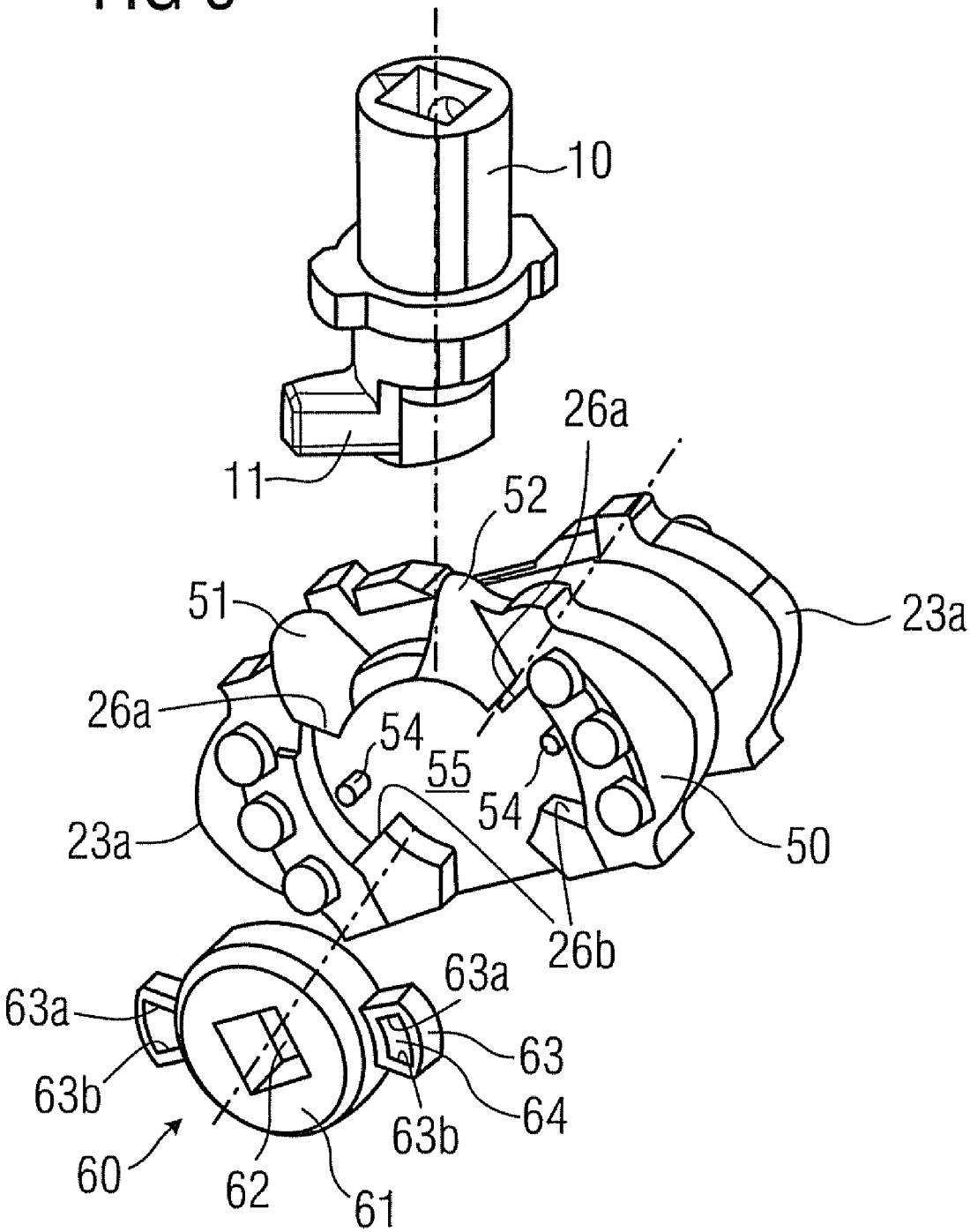
FIG. 9 shows a schematic illustration of the design of a further embodiment of the disconnector.

FIG. 9 shows a schematic illustration of the design of a further example embodiment of the disconnector according to this invention. The design is similar to that of the disconnector in example embodiment 1. The corresponding design and the functions of the disconnector from example embodiment 1 will not be repeated here. Only the differences between the two are described.

In order to simplify the description, the cam wheel which is in the form of a disk has the reference symbol 50 in this example embodiment. The first protuberance 51 and the second protuberance 52 are provided on it. During operation, the two protuberances 51 or 52 on the cam wheel 50 which is in the form of a disk make contact with the pivoting element 11 of the operating element 10, thus changing the open/close switching state of the disconnector. The holding opening 55 is incorporated on the end surface, which is in the form of a disk, of the cam wheel 50, which is in the form of a disk. Two positioning bolts 54 are furthermore provided in the holding opening 55.

As illustrated in FIG. 9, an operating element 60 is provided in the holding opening 55, with the operating element 60 comprising a body 61, and with an operating opening 62 being located in the center part of the body 61. Two vane pieces 63 are provided on both sides of the body 61. A vane opening 64 is located in each vane piece 63 (in order to make the illustration in FIG. 9 clearer, only one vane piece and one vane opening are indicated). When the operating element 60 is fitted into the holding opening 55, each positioning bolt 54 is in each case placed in one vane opening 64. Each positioning bolt 54 can rotate in the vane opening 64 relative to the vane opening 64 within an angular play which is formed by stops 63*a* and 63*b*. After contact with a stop 63*a* or 63*b*, the angular play makes it possible to rotate the positioning bolts 54 and the cam wheel 50, which is in the form of a disk, by rotation of the vane openings 64.

Technical personnel in this field should understand that the same configuration as that in example embodiment 1 can be used for the holding opening 55 in this example embodiment, that is to say two vane openings 64 are incorporated, which correspond to the two vane pieces 63. In order to simplify the machining, it is also possible not to incorporate just vane openings 64, but, for example, to use a configuration in the form of a plate. This is dependent on the capability to hold the operating element, and the rotation of the vane pieces 63 produced thereby.

In this example embodiment, the disconnector operates on the same principle as that in example embodiment 1. In the same way, it is possible, as illustrated in FIGS. 3 to 8, to operate the disconnector from the side and from the front, in which case operation from the side is also independent manual operation, which will not be explained in detail again here.

In precisely the same way as in example embodiment 1, both operation from the front as in the case of conventional products and a change to operation from the side, in a simple manner, can be used for the disconnector illustrated in this example embodiment. Since the positioning bolts 54 can rotate in the vane openings 64 relative to the vane openings 64, the rate of manual operation furthermore affects only the rate of rotation of the positioning bolts 54 in the vane openings 64, but has no influence on the actual switching rate of the switch. This results in independent manual operation from the side, without adding an additional apparatus.

The series of detailed descriptions which have been provided in the text above are only specific descriptions which are directed at feasible example embodiments of this invention. In no way do they serve to restrict the scope of protection of this invention. All equivalent example embodiments or modifications which do not depart from the technical teaching of this invention are intended to be included in the scope of protection of this invention.

What is claimed is:

1. A disconnector, comprising:

a cam wheel, via which, the disconnector is switchable on and off, the cam wheel being mounted so as to be rotatable between two limit positions, one limit position corresponding to a switched-on state and the other corresponding to a switched-off state of the disconnector;

two cams, formed on the cam wheel, located opposite one another and extending transversely with respect to a rotation axis of the cam wheel, wherein the two cams include an external contour with an apex point;

two pressure elements, each resting on the external contour, to apply force and press against the cams, each of the two pressure elements producing a torque during rotation of the cam wheel after passing over the apex point, the torque automatically rotating the cam wheel further to the respective limit position;

a rotatable first operating element, whose rotation axis runs transversely with respect to the rotation axis of the cam wheel and on which a pivoting element is arranged, wherein the pivoting element extends outward transversely with respect to the rotation axis of the first operating element;

two protuberances, arranged between the cams with an angular separation on the cam wheel, wherein the pivoting element extends into the space between the two protuberances, presses against one of the protuberances during pivoting, and in the process rotates the cam wheel beyond the apex point in the direction of a limit position;

a holding opening, formed in the cam wheel and running in a direction of the rotation axis of the cam wheel;

a second operating element including a body, mounted in the holding opening so as to be rotatable with an angular play; and two stops, to limit the angular play and about which the cam wheel is rotatable by the second operating element beyond the apex point in the direction of a limit position.

2. The disconnector as claimed in claim 1, wherein the holding opening is provided with vane openings which correspond to vane pieces, the vane pieces being rotatable relative to the vane openings.

3. The disconnector as claimed in claim 2, wherein the two vane pieces are fitted radially symmetrically on both sides of the body.

4. The disconnector as claimed in claim 2, wherein each vane piece is provided internally with a vane opening.

5. The disconnector as claimed in claim 4, wherein the two vane pieces are fitted radially symmetrically on both sides of the body.

6. The disconnector as claimed in claim 4, wherein the holding opening is provided internally with two positioning bolts, each positioning bolt being located in a vane opening, and rotation relative to the positioning bolts being possible in the vane openings.

7. The disconnector as claimed in claim 6, wherein the two vane pieces are fitted radially symmetrically on both sides of the body.

8. The disconnector as claimed in claim 1, wherein each vane piece is provided internally with a vane opening.

9. The disconnector as claimed in claim 8, wherein the two vane pieces are fitted radially symmetrically on both sides of the body.

10. The disconnector as claimed in claim 8, wherein the holding opening is provided internally with two positioning bolts, each positioning bolt being located in a vane opening, and rotation relative to the positioning bolts being possible in the vane openings.

11. The disconnector as claimed in claim 10, wherein the two vane pieces are fitted radially symmetrically on both sides of the body.

* * * * *